United States Patent [19]

Becker et al.

[11] Patent Number: 4,906,557

[45] Date of Patent: Mar. 6, 1990

[54] PHOTOGRAPHIC RECORDING MATERIAL AND PROCESS FOR THE PRODUCTION OF PHOTOGRAPHIC IMAGES

[75] Inventors: Manfred Becker; Reinhart Matejec, both of Leverkusen; Hans Öhlschläger, Bergisch Gladbach, all of Fed. Rep. of Germany

[73] Assignee: Agfa-Gevaert Aktiengesellschaft, Leverkusen, Fed. Rep. of Germany

[21] Appl. No.: 309,042

[22] Filed: Feb. 9, 1989

Related U.S. Application Data

[63] Continuation of Ser. No. 13,634, Feb. 11, 1987, abandoned.

[30] Foreign Application Priority Data

Feb. 22, 1986 [DE] Fed. Rep. of Germany ..... 3605712

[51] Int. Cl.[4] ..... G03C 1/34; G03C 1/06

[52] U.S. Cl. ..... 430/543; 430/567; 430/611; 430/614

[58] Field of Search ..... 430/567, 611, 614, 543

[56] References Cited

U.S. PATENT DOCUMENTS 3,645,738 2/1972 Willems et al. ..... 430/611
4,636,461 1/1987 Becker et al. ..... 430/567

FOREIGN PATENT DOCUMENTS 0147854 7/1985 European Pat. Off. .
25217 3/1975 Japan .

OTHER PUBLICATIONS

Research Disclosure 24236, Jun. 1984.

*Primary Examiner*—Paul R. Michl
*Assistant Examiner*—Mark A. Buscher
*Attorney, Agent, or Firm*—Connolly & Hutz

[57] ABSTRACT

Improved photographic recording materials contain silver halide grains having at least two zones differing in their halide composition and, as stabilizer, a compound corresponding to the formula

8 Claims, No Drawings

PHOTOGRAPHIC RECORDING MATERIAL AND PROCESS FOR THE PRODUCTION OF PHOTOGRAPHIC IMAGES

This application is a continuation of application Ser. No. 13634, filed Feb. 11, 1987 now abandoned.

This invention relates to a photographic recording material containing a stabilizer and to a process for the production of photographic images.

It is well known that recording materials containing light-sensitive silver halide emulsions, especially those which are chemically sensitized, tend to fogging due to the presence of nuclei which are capable of developing without exposure to light. This fogging occurs in particular in the course of prolonged storage, especially at elevated temperatures and atmospheric moisture contents.

It is known to add so-called anti-foggants and stabilizers to photographic silver halide emulsions to reduce fogging, e.g. heterocyclic compounds containing sulphur, for example in the form of a mercapto group.

See in this connection, for example, German Auslegeschriften Nos. 1 183 371 (GB No. 1 067 066), DE No. 1 189 380 (U.S. Pat. Nos. 3 364 028 and 3 365 294), DE No. 1 597 503 (U.S. Pat. No. 3 615 617) and DE No. 1 979 027, and German Offenlegungsschriften Nos. 1 522 363 (GB No. 1 186 441), DE No. 2 042 533 (U.S. Pat. No. 3 761 278), DE Nos. 2 130 031 and 2 308 530.

Silver halide crystals having at least two zones differing in their composition are also known. GB-PS 1 027 146, for example, describes crystals composed of a core of silver bromide over which is a zone of silver iodobromide which in turn is covered by a shell of silver bromide. Silver halide emulsions in which the silver halide grains have a core of silver iodide covered by a shell of some other silver halide are disclosed in DE-OS No. 3 205 896 and GB-A No. 2 095 853. Silver halide grains which have a relatively iodide-rich zone in their interior covered by an outer zone which has a relatively low iodide content are disclosed in European Pat. No. 0 006 543 and Canadian Pat. No. 1 155 325.

Photographic recording materials having silver halide grains containing zones with differing compositions have also been disclosed, for example, in German Pat. No. 3 416 951, U.S. Pat. No. 4 469 784, EP-A-Nos. 147 854 and 147 868. In the last two applications mentioned, it is stated that fogging may be prevented inter alia by means of oxazolinethiones.

Stabilizers and anti-foggants generally not only reduce fogging but also reduce the sensitivity. It was therefore an object of the present invention to provide photographic recording materials which have the known advantages of silver halide crystals containing at least two zones but which are so stabilized that the ratio of sensitivity to fogging is improved, especially under conditions of storage at elevated temperatures and elevated moisture levels.

A photographic recording material containing at least one light-sensitive silver halide emulsion layer and a stabilizer has now been found, which is characterised in that the silver halide emulsion layer contains silver halide grains having at least two zones differing in their halide composition and in that the stabilizer contained in the material is a compound corresponding to the following formula I or a tautomer thereof:

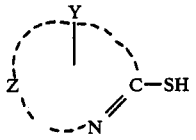

I wherein

Z denotes the atoms required for completing an oxazole or oxazine ring and

Y denotes a condensed aromatic ring system having at least one aromatic ring which may be substituted with at least one acid group or a substituent, preferably phenyl, having at least one acid group.

The silver halide stabilizers used according to the invention are heterocyclic mercapto compounds in which the heterocyclic group contains at least one oxazole or oxazine ring. The following are examples of such heterocyclic groups: Oxazole, benzoxazole, naphth[1,2:d]oxazole, naphth[2,3:d]oxazole, naphth[2,1:d]oxazole, oxazine and naphth[1,8:de]oxazine. The oxazole and oxazine rings contain substituents with acid groups or condensed aromatic rings having acid groups preferably attached thereto. Examples of such acid groups are COOH, $SO_3H$ and $SO_2$—NH—R (wherein R=H, alkenyl or aryl).

Compound I may also contain additional substituents, e.g. alkyl groups, halogen groups, ether groups or ester groups.

The sulphonamide group may in turn be substituted by alkyl, aralkyl or aryl groups.

In one particularly preferred embodiment, the compounds corresponding to formula I are benzoxazoles, in particular of the kind corresponding to formula II

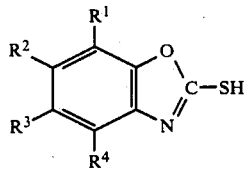

II wherein $R^1$–$R^4$ may be identical or different and denote hydrogen or alkyl, in particular with 1 to 4 carbon atoms, and two of the substituents $R^1$ to $R^4$ may together constitute the group required for completing a ring, in particular a condensed phenyl ring, with the proviso that at least one of the substituents $R^1$ to $R^4$ contains an acid substituent or is itself an acid substituent.

Furthermore, a process for the production of photographic images by imagewise exposure and processing of a photographic recording material has been found, which is characterised in that a recording material according to the invention is used.

Particularly preferred compounds corresponding to formula I are shown in the Table below.

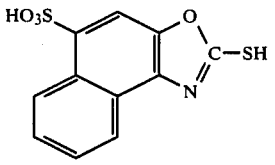

St-1

-continued

St-2

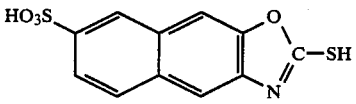

St-3

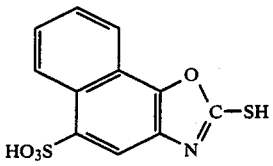

St-4

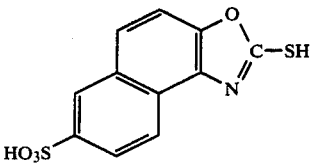

St-5

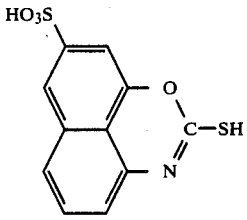

St-6

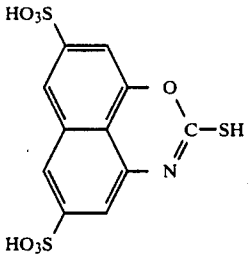

St-7

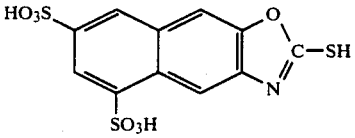

St-8

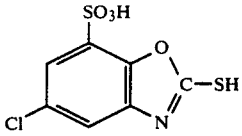

St-9

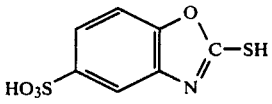

St-10

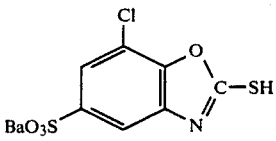

St-11

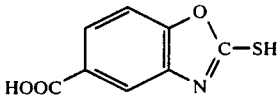

-continued

St-12

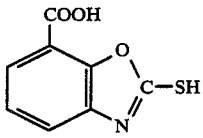

St-13

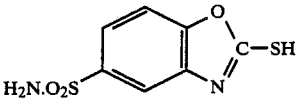

St-14

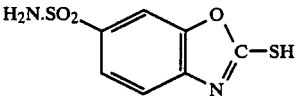

St-15

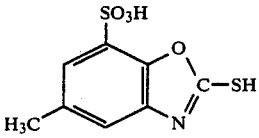

St-16

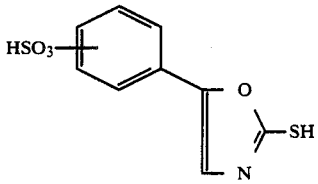

St-17

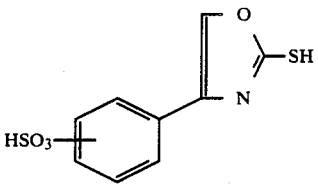

St-18

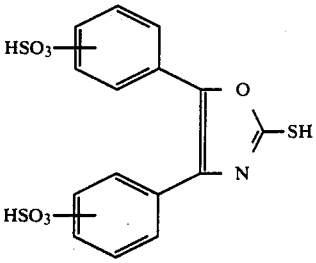

The compounds according to the invention are advantageously added in the form of solutions. Examples of suitable solvents for this purpose include lower alcohols, tetrahydrofuran, N-methylpyrrolidone and acetone.

The compounds to be used according to the invention are preferably added in quantities of $10^{-5}$ to $10^{-2}$ mol, preferably $10^{-4}$ to $10^{-3}$ mol per mol of silver halide.

The emulsions may contain other anti-foggants and stabilizers in combination with the stabilizers according to the invention. Azaindenes are particularly suitable, especially tetra- and penta-azaindenes, in particular those which are substituted with hydroxyl or amino groups. Compounds of this type are described, for example, in the article by Birr, Z. Wiss. Phot. 47, (1952), pages 2–58. Other suitable stabilizers and anti-foggants are mentioned in Research Disclosure No. 17643 of Dec. 1978, Section VI, published by Industrial Opportunities Ltd., Homewell Havant, Hampshire, P09 1 EF of Great Britain.

The stabilizers, including the compounds to be used according to the invention, may be added to the light-sensitive silver halide emulsions before, during or after chemical ripening. In a preferred embodiment, they are added to the finished casting solution after chemical ripening.

The silver halides used in the present invention may be silver chloride, silver bromide or mixtures thereof, optionally with a silver iodide content of preferably 10 mol-% or less, and the halide may be distributed within the grain according to a gradient.

The silver halide emulsions may be prepared by the usual methods (e.g. single inflow, double inflow, with constant or accelerated supply of material). The method of preparation by double inflow with control of the pAg-value is particularly preferred; see the above-mentioned Research Disclosure No. 17643, Sections I and II.

Photographically active compounds such as compounds of copper, thallium, lead, bismuth, cadmium, ruthenium, rhodium, palladium, osmium, iridium, platinum, gold, sulphur, selenium and tellurium may be present during the precipitation.

The silver halide grains may be present in any crystalline form, e.g. as cubes, octahedrons, tetradecahedrons, etc.

In a preferred embodiment, the halides are predominantly in the form of compact crystals which may assume, for example, cubical, octahedral or transitional forms. They may be characterised by the fact that they mainly have a thickness of more than 0.15 μm. The average ratio of their diameter to thickness is preferably less than 8:1, the diameter of the grain being defined as the diameter of a circle having an area equal to the projected area of the grain. In another preferred embodiment, all or some of the emulsions may have mainly tabular silver halide crystals in which the ratio of diameter to thickness is greater than 8:1. The emulsions may be monodisperse emulsions with an average grain size preferably in the range of 0.2 μm to 1.3 μm.

The edges and corners of the silver halide grains may be rounded off and may have one or more twinning planes. The silver halide grains may have depressions on at least one of their surfaces or they may have warts. The grain size distribution of the silver halide grains may be monodisperse, oligodisperse or polydisperse. According to the invention, the silver halide grains have at least two zones of different composition, and the transition between these two zones may be sharp or gradual. In the simplest case, the silver halide grains have at least one core and a shell round this core. Additional, internal shells may be situated between the core and the outer shell. The core and the shells will hereinafter be referred to as zones. The individual zones may contain inclusions having a different composition, in particular inclusions with a higher iodide content. The halides in the individual zones may be chloride, bromide, iodide or mixtures thereof. If the iodide content is distributed along a gradient, it is preferably higher in the core or in the vicinity of the core than in a more externally situated zone. In a preferred embodiment, the core consists mainly of silver bromide, the outermost zone consists of a silver iodobromide emulsion with a relatively low iodide content and between these two zones is at least one intermediate zone consisting of a silver iodobromide emulsion with a relatively high silver iodide content, in particular a silver iodide content of at least 5 mol-%. According to one particularly preferred embodiment, at least one zone situated between the core and the outermost shell contains a silver iodobromide emulsion with an iodide content of 7 to 40%.

When chlorobromide emulsions are used, the chloride content is preferably in the range of 5 to 95%. However, one or more silver iodochloride zones may be used in an emulsion.

In a particularly preferred embodiment, the silver halide grains have the following structure:

(a) From the surface of the grain to its centre there are at least three successive zones differing in their halide composition, and the local iodide content assumes a maximum in at least one position which is neither on the surface nor at the centre, such that (b) the difference between the iodide content in the zone having the highest iodide content and the iodide content of the zone with the lowest iodide content, which is situated further from the centre of the grain, is at least 6 mol-%, preferably at least 8 mol-% and in one particularly preferred embodiment at least 9 mol-%, and (c) the proportion (in mol-% of silver halide) of the zones in which the iodide content assumes a maximum is from 10 to 60%, preferably from 15 to 50% and most preferably from 20 to 40%, and (d) at least 50%, preferably at least 70% of the silver halide crystals are cubes or tetradecahedrons or transitional forms between cubes and tetradecahedrons, and rounded crystal surfaces may occur in the case of transitional forms.

If the silver halide grain has only two zones of differing compositions, the proportion of the core preferably amounts to at the most 80%. If additional inner zones are situated between the core and the outermost zone, then the core preferably makes up 5 to 40 mol-% and the outermost zone 20 to 40% of the whole silver halide grain.

The diameter of a sphere having the same volume as a silver halide grain of the silver halide emulsions to be used according to the invention is preferably 0.15 μm to 2.3 μm, in particular 0.2 μm to 1.3 μm.

The emulsions are preferably chemically sensitized to a high degree of surface sensitivity on the surface of the grain but at least one of the inner zones may in addition be chemically sensitized before the grain has completed its growth. The known methods may be used for chemical sensitization, e.g. sensitization may be carried out with active gelatine or with compounds of sulphur, selenium, tellurium, gold, palladium, platinum or iridium, and the pAg values during such chemical sensitization may fluctuate from 4 to 10 and the pH values in the region of 3.5 to 9 while the temperatures may vary from 30° C. to 90° C. Chemical sensitization may be carried out in the presence of heterocyclic nitrogen compounds such as imidazoles, azaindenes, azapyridazines, azapyrimidines and thiocyanate derivatives, thioethers and other silver halide solvents. Instead of or in addition to these methods, the emulsions according to the invention may be subjected to a process of sensitization by reduction, e.g. by means of hydrogen, a low pAg (e.g. below 5) and/or by pH (e.g. above 8) or reducing agents such as tin(II) chloride, thiourea dioxide and aminoboranes.

The surface ripened nuclei may also be present as troglodyte nuclei (sub-surface nuclei) according to DE-OS No. 2 306 447 and U.S. Pat. No. 3 966 476. Other methods have been described in the above-mentioned Research Disclosure No. 17643, Section III.

The emulsions may be oxidized during and/or after precipitation and before, during and/or after chemical ripening, e.g. by means of iron(III) compounds, mercury(II) compounds or N-(m-nitrobenzyl)-quinolinium chloride.

The emulsions may be optically sensitized in known manner, e.g. with the usual polymethine dyes such as neutrocyanines, basic or acid carbocyanines, rhodacyanines, hemicyanines, styryl dyes, oxanoles and the like. Sensitizers of this kind have been described by F. M. Hamer in "The Cyanine Dyes and related Compounds" (1964); see also Ullmanns Enzyklopädie der technischen Chemie, 4th Edition, Volume 18, pages 431 et seq, and the above mentioned Research Disclosure No. 17643, Section IV.

The emulsions according to the invention may be mixed with each other or with other emulsions.

The colour photographic recording materials normally contain at least one silver halide emulsion layer unit for recording light from each of the three spectral regions, red, green and blue.

Each of the above-mentioned silver halide emulsion layer units may contain only one or several silver halide emulsion layers. Colour photographic recording materials containing double layers for the various spectral regions have been disclosed, for example, in U.S. Pat. Nos. 3 663 228, 3 849 138 and 4 184 876. Colour photographic recording materials with triple layers have been disclosed in DT-OS No. 2 018 341 and DE No. 3 413 800.

The photographic materials may in addition contain formalin acceptors in any of the layers, e.g. the iminopyrazolones disclosed in German Pat.No. 3 148 108 and U.S. Pat. No. 4 414 309.

Preferably at least one blue-sensitive layer is arranged above the green- and red-sensitive layers and separated from these by a yellow filter layer. Other protective and intermediate layers may be used in addition to the light-sensitive layers.

In addition to the layers already mentioned above, the colour photographic recording material according to the invention may contain other, light-insensitive auxiliary layers, e.g. bonding layers, antihalation layers or covering layers, in particular intermediate layers between the light-sensitive layers to prevent the diffusion of developer oxidation products from one layer to another. For this purpose, such intermediate layers may contain certain compounds capable of reacting with developer oxidation products. These layers are preferably arranged between adjacent light-sensitive layers which differ in their spectral sensitivity. A low sensitivity silver halide emulsion having an average grain diameter of about 0.8 μm or less and containing chloride, bromide and optionally iodide may also be incorporated in intermediate layers. Such a layer has a particularly advantageous effect on the sensitivity of the adjacent layers. However, the low sensitivity silver halide emulsion may also be directly introduced into the light-sensitive layer itself.

The layers may in addition contain the usual components such as scavengers, DIR couplers and DAR couplers.

The light-sensitive silver halide emulsion layers preferably have colour couplers associated with them which are capable of reacting with colour developer oxidation products to form a dye. The colour couplers are preferably arranged in the direct vicinity of the silver halide emulsion layer and in particular in this layer itself.

Thus the red-sensitive layer, for example, may contain a colour coupler for producing the cyan partial colour image, generally a coupler of the phenol or α-naphthol series. The green-sensitive layer, for example, may contain at least one colour coupler for producing the magenta partial colour image, usually a colour coupler of the 5-pyrazolone series. The blue-sensitive layer, for example, may contain at least one colour coupler for producing the yellow partial colour image, generally a colour coupler containing an open chain ketomethylene group.

The colour couplers may consist, for example, of 6-, 4- or 2-equivalent couplers. Suitable couplers are mentioned, for example, in the publication "Farbkuppler" by W. Pelz in "Mitteilungen aus den Forschungslaboratorien der Agfa, Leverkusen/München", Volume III, page 111 (1961); by K. Venkataraman in "The Chemistry of Synthetic Dyes", Volume 4, 341 to 387, Academic Press (1971) and by T. H. James in "The Theory of the Photographic Process", 4th Edition, pages 353 to 362, and in Research Disclosure No. 17643 of Dec. 1978, Section VII, published by Industrial Opportunities Ltd., Homewell Havant, Hampshire, P09 1 EF, Great Britain.

The usual masking couplers may be used to improve colour reproduction. The recording material may also contain DIR compounds and white couplers which react with colour developer oxidation products without producing a dye. The inhibitors in the DIR compounds may be split off directly from these compounds or by way of noninhibitory intermediate compounds.

See GB No. 953 454, U.S. Pat. Nos. 3 632 345, 4 248 962 and GB No. 2 072 363 and Research Disclosure No. 10226 of Oct. 1972. Examples of particularly suitable yellow couplers are shown in the Table below:

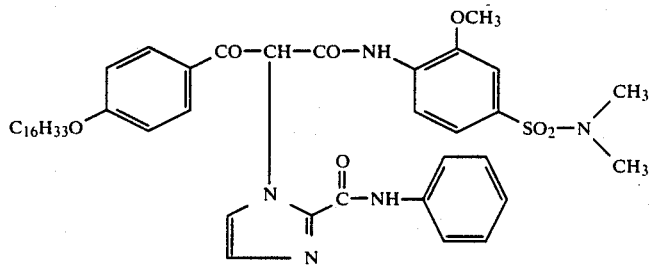

Y1

-continued
Y2
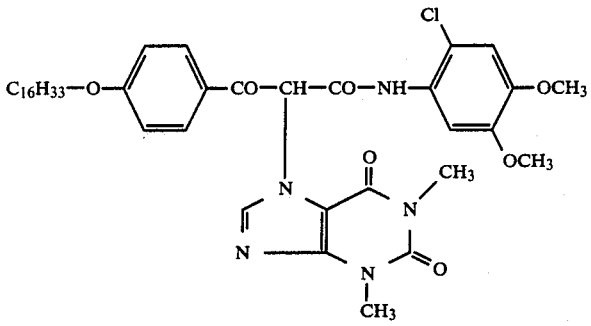
Y3
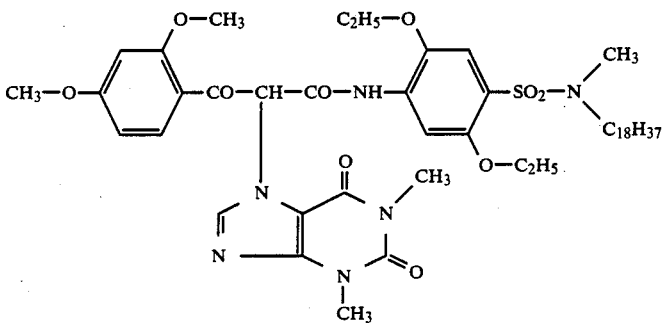
Y4
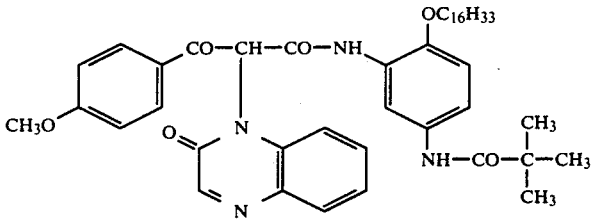
Y5
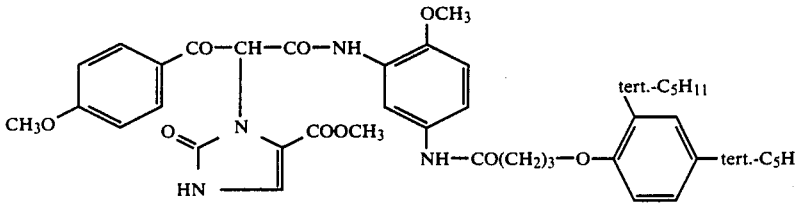
Y6
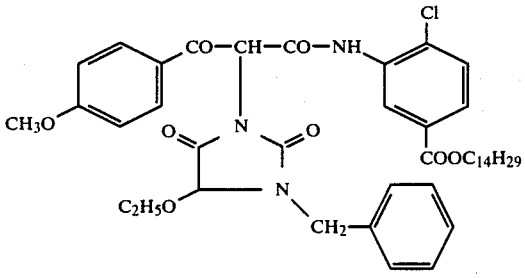
Y7
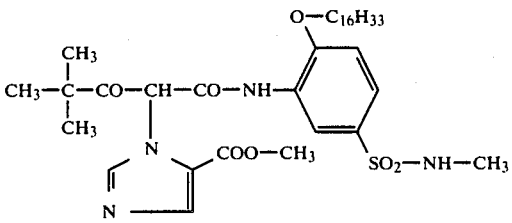

-continued
Y8
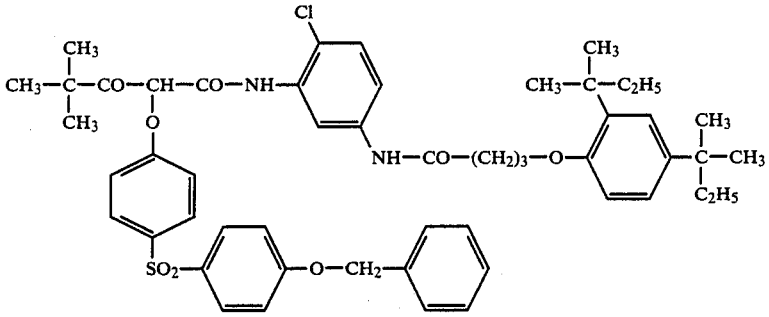
Y9
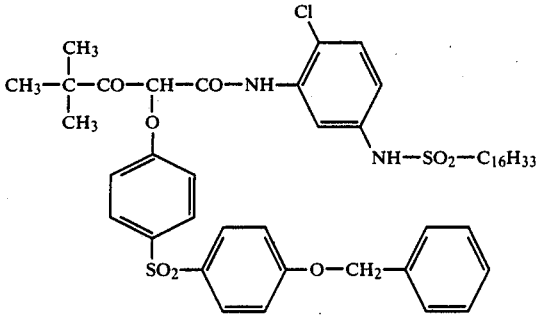
Y10
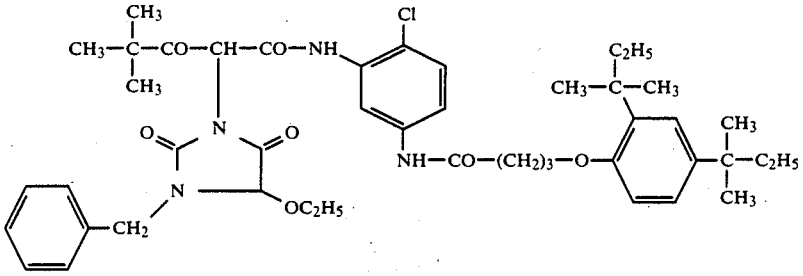
Y11
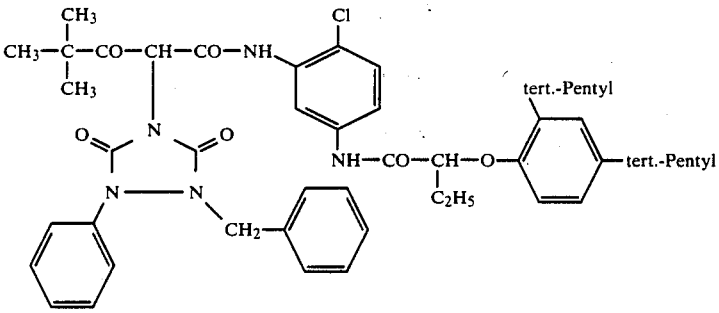
Y12
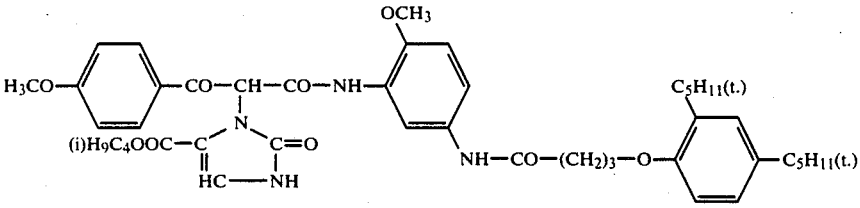

-continued
Y13
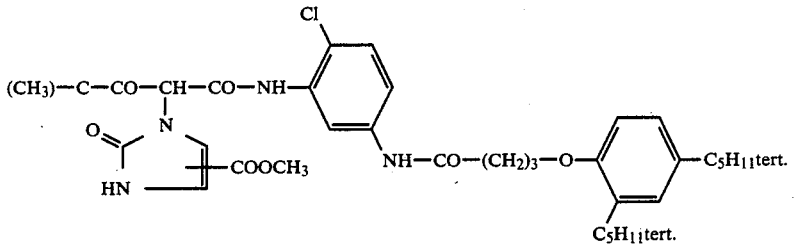
Y14
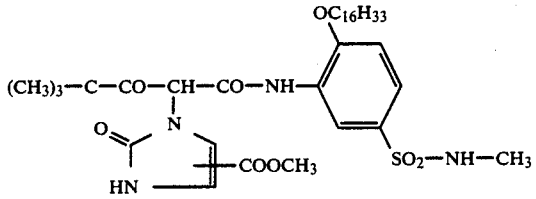
Examples of particularly suitable cyan couplers are shown in the following Table:
C1
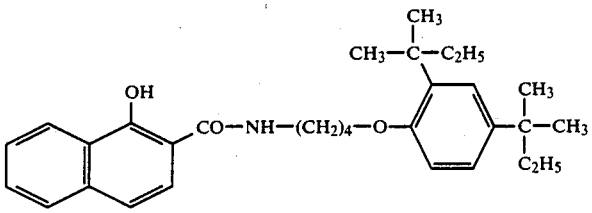
C2
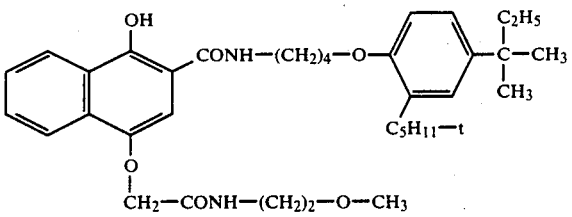
C3
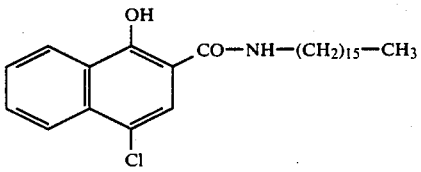
C4
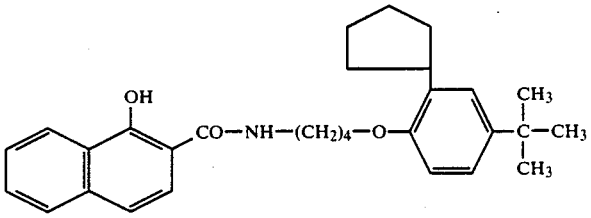
C5
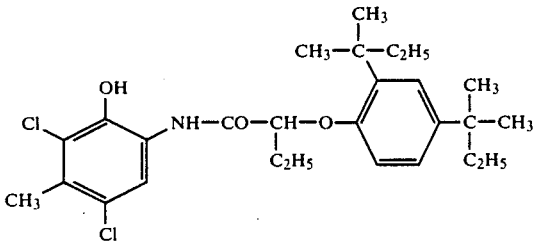

-continued
C6
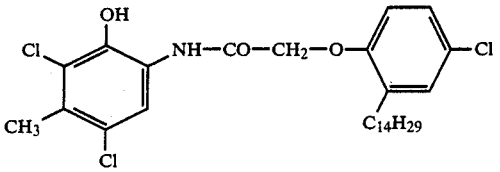
C7
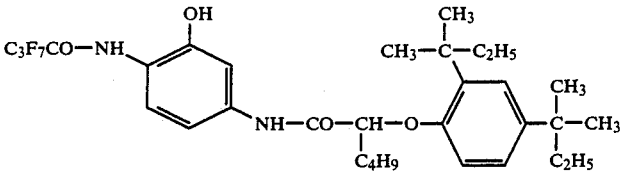
C8
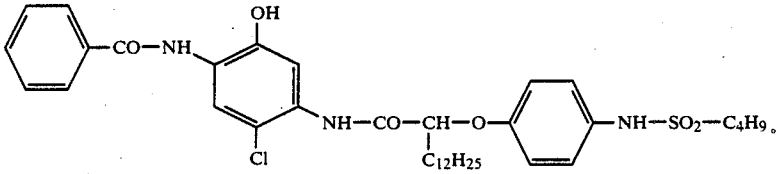
C9
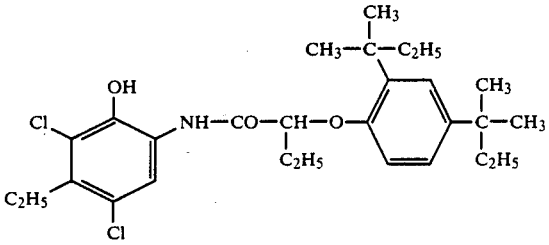
C10
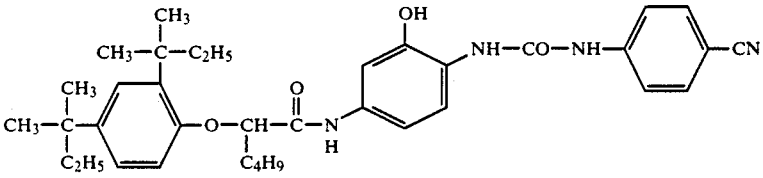
C11
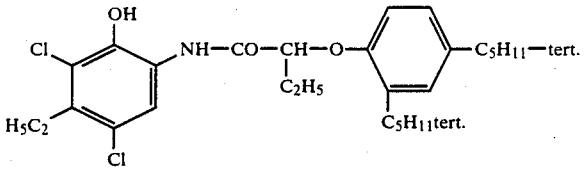
C12
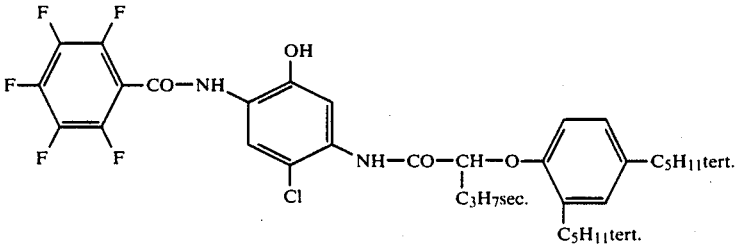
The following compounds may be used as magenta couplers:

Pp 1
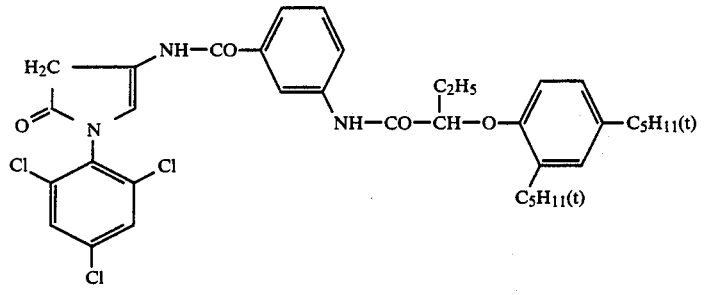
Pp 2
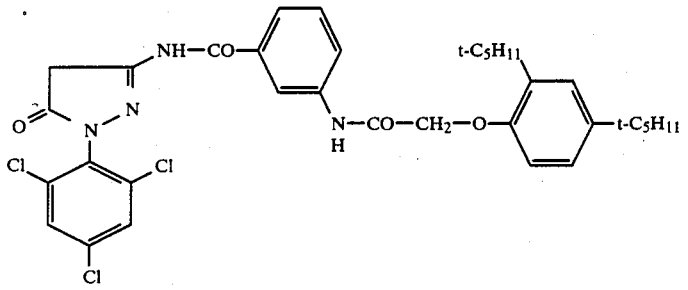
Pp 3
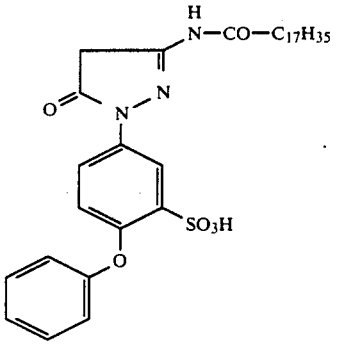
Pp 4
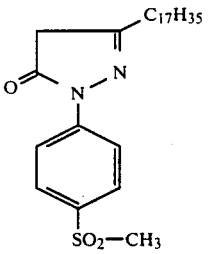
Pp 5
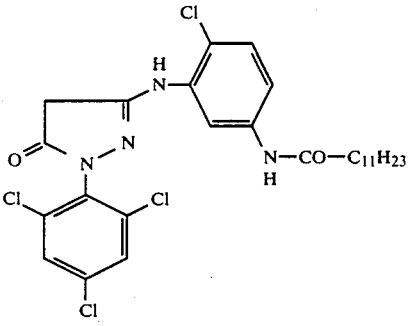

-continued
Pp 6
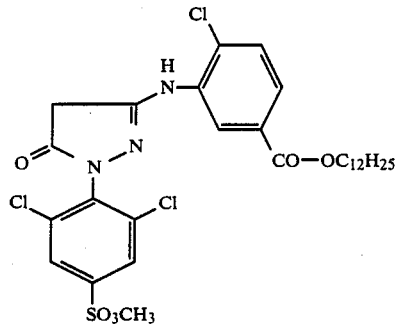
Pp 7
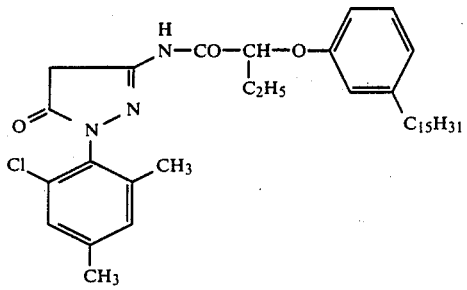
Pp 8
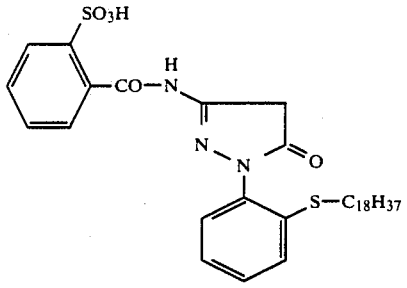
Pp 9
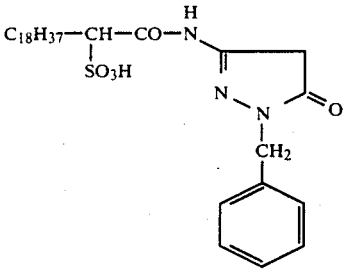
Pp 10
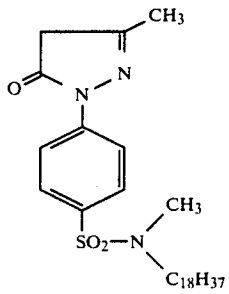

-continued
Pp 11
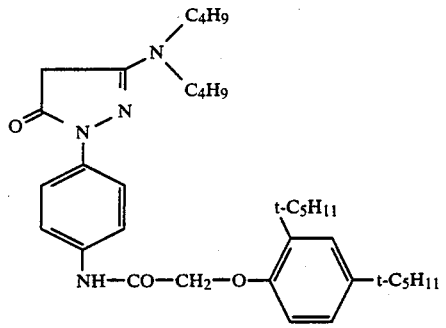
Pp 12
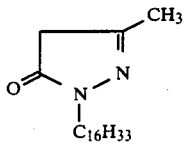
Pp 13
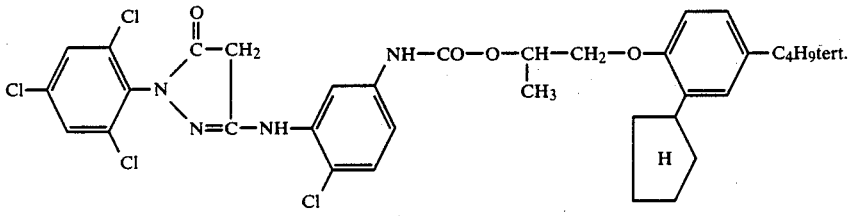
Pp 14
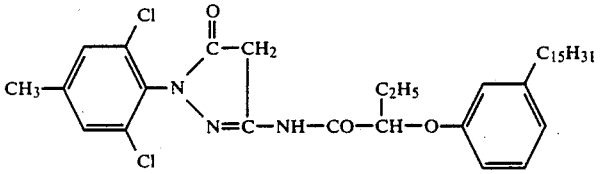
Pp 15
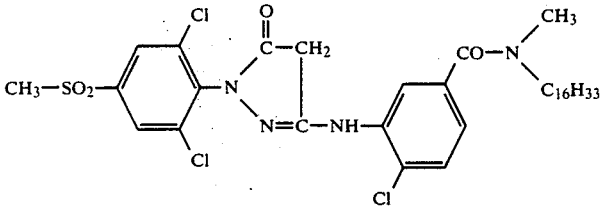
Pp 16
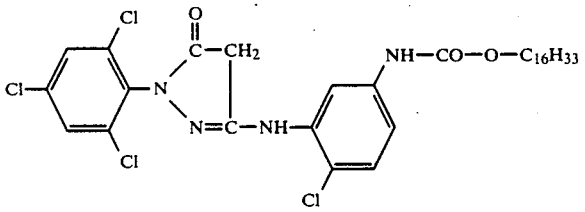
Pp 17
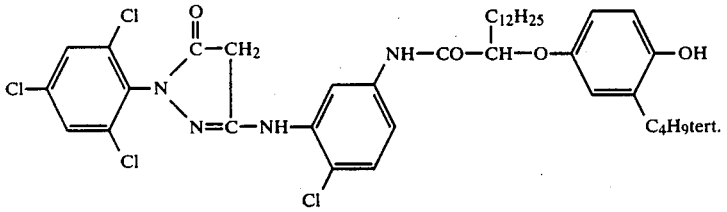

-continued
Pp 18
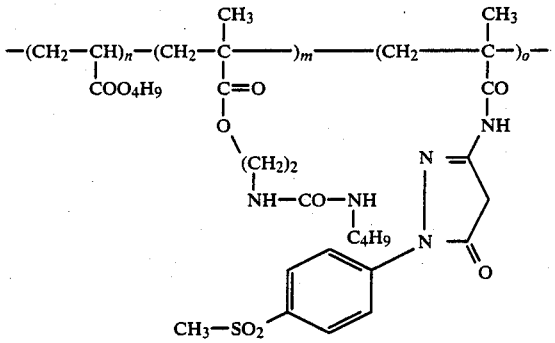
Pp 19
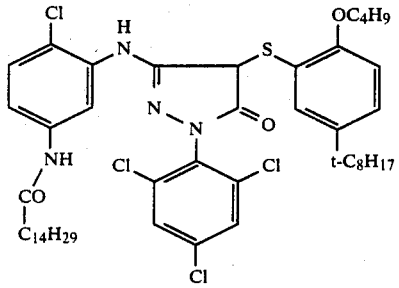
Pp 20
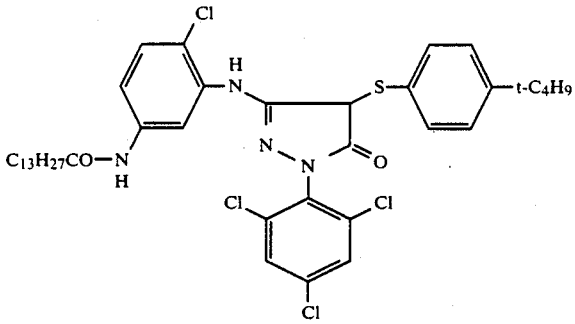
Pp 21
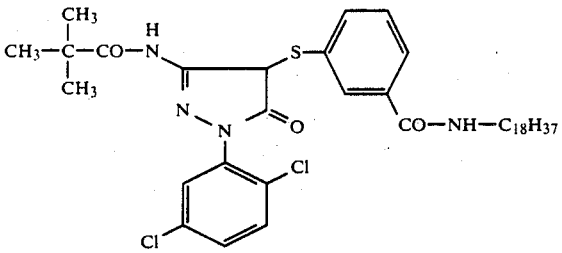
Pp 22
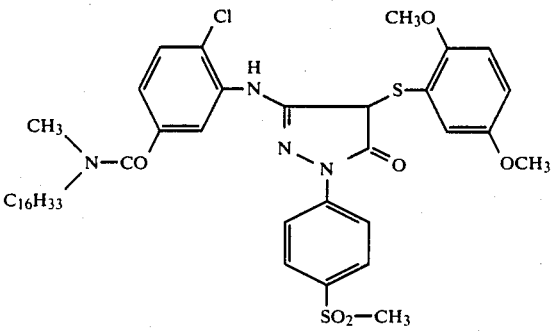

-continued
Pp 23
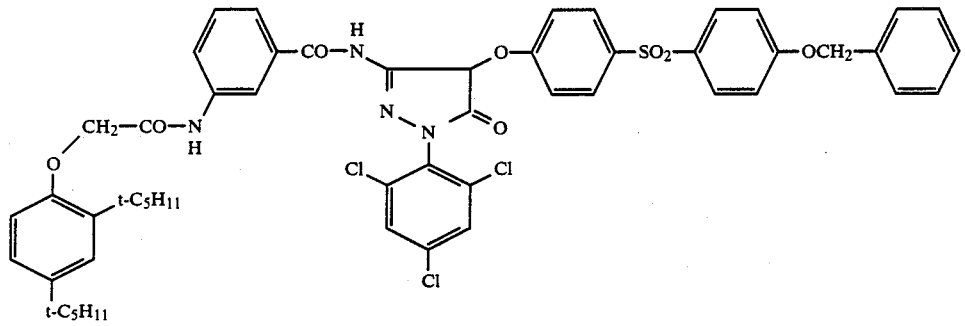
Pp 24
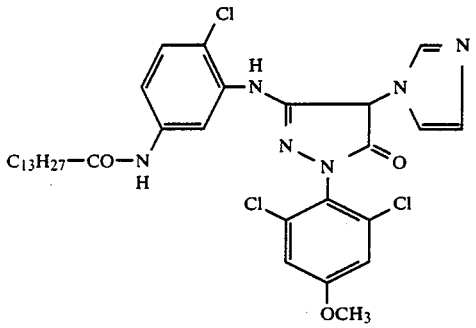
Pp 25
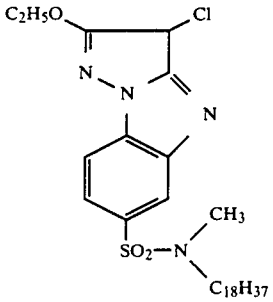
Pp 26
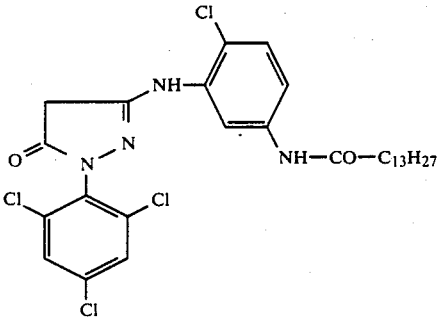
Pp 27
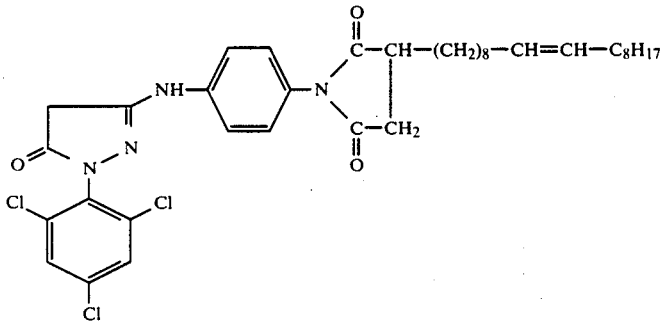

-continued

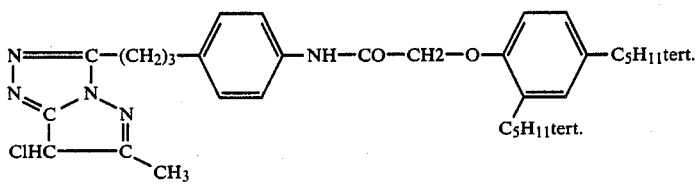

Pp 28

Suitable DIR couplers may have, for example, the following structure:

DIR 1

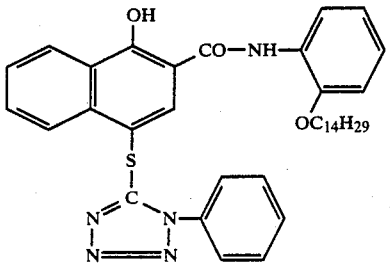

DIR 2

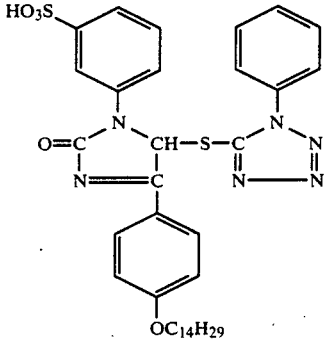

The components of the photographic material may be incorporated by the usual, known methods. If they are compounds which are soluble in water or alkalies, they may be added in the form of aqueous solutions, optionally with the addition of water-miscible organic solvents such as ethanol, acetone or dimethylformamide. If the compounds are insoluble in both water and alkalies, they may be incorporated with the recording materials in the form of dispersions in known manner. For example, a solution of these compounds in a low boiling organic solvent may be directly mixed with the silver halide emulsion or it may first be mixed with an aqueous gelatine solution from which the organic solvent is subsequently removed and the resulting dispersion of the given compound may then be mixed with the silver halide emulsion. So-called oil formers may be used in addition. These are generally relatively high boiling organic compounds which form oily droplets enclosing the compounds which are to be dispersed.

See in this connection, for example, U.S. Pat. Nos. 2 322 027, 2 533 514, 3 689 271, 3 764 336 and 3 765 897. The couplers may also be incorporated, for example, in the form of charged latices, see DE-OS No. 2 541 274 and EP-A No. 14 921. The components may also be fixed in the material as polymers, see e.g. DE-QS No. 2 044 992, U.S. Pat. Nos. 3 370 952 and 4 080 211.

The usual layer supports may be used for the materials according to the invention, see Research Disclosure No. 17643, Section XVII.

The usual hydrophilic film forming agents may be used as protective colloids or binders for the layers of the recording material, e.g. proteins, in particular gelatine. Casting auxiliaries and softeners may also be used; see the compounds indicated in the above-mentioned Research Disclosure 17643, Sections IX, XI and XII.

The layers of the photographic material may be hardened in the usual manner, for example with hardeners of the type of epoxides, heterocyclic ethyleneimine and acryloyl. The layers may also be hardened by the process according to German Offenlegungsschrift No. 2 218 009 to produce colour photographic materials suitable for high temperature processing. Hardeners of the diazine, triazine or 1,2-dihydroquinoline series or hardeners of the carbamoyl pyridinium or vinylsulphone type may also be used for the photographic layers. Suitable hardeners are disclosed in German Offenlegungsschriften Nos. 2 439 551, 2 225 230 and 2 317 272 and the above mentioned Research Disclosure 17643, Section XI.

Other suitable additives are mentioned in Research Disclosure 17643 and in "Product Licensing Index" of Dec. 1971, pages 107 to 110.

Suitable colour developer substances for the material according to the invention include in particular those of the p-phenylenediamine series, e.g. 4-amino-N,N-diethylaniline hydrochloride; 4-amino-3-methyl-N-ethyl-N-β-(methanesulphonamido)-ethylaniline sulphate hydrate; 4-amino-3-methyl-N-ethyl-N-β-hydroxyethylaniline sulphate; 4-amino-N-ethyl-N-(2-methoxyethyl)-m-toluidine-di-p-toluene sulphonic acid and N-ethyl-N-β-hydroxyethyl-p-phenylene diamine. Other suitable colour developers are described, for example, in J. Amer. Chem. Soc. 73, 3100 (1951) and by G. Haist in Modern Photographic Processing, 1979, John Wiley and Sons, N.Y., pages 545 et seq.

The material is normally bleached and fixed after colour development. Bleaching and fixing may be carried out separately or together. The usual bleaching agent compounds may be used, e.g. $Fe^{3+}$ salts and $Fe^{3+}$ complex salts such as ferricyanide, dichromate, water-soluble cobalt complexes, etc. Iron-III complexes of aminopolycarboxylic acids are especially preferred, in particular, for example, the complexes of ethylenediaminotetracetic acid, nitrilotriacetic acid, iminodiacetic acid, N-hydroxy-ethyl-ethylenediaminotriacetic acid and alkylimino dicarboxylic acids and of corresponding phosphonic acids. Persulphates are also suitable bleaching agents.

The following Examples, in which the preferred embodiments of the invention are described, serve to illustrate the invention. The percentages refer to percentages by weight and quantities given refer to the amount applied to 1 $m^2$ of recording material, unless otherwise indicated The quantity of silver halide applied is given in terms of the equimolar quantity of silver nitrate.

EXAMPLES

PREPARATION OF THE EMULSIONS

Emulsions A and B are Comparison emulsions which do not have zones of differing compositions and emulsions C, D and E are emulsions to be used according to the invention. Emulsions having the composition shown in the following Table were prepared by the double inflow process. The silver halide grains were cubic. The emulsions were ripened to optimum photographic sensitivity with sodium thiosulphate, ammonium dithiocyanate aurate (I) and ammonium thiocyanate.

TABLE

| Emulsion | Zone No. | Composition of zones | Proportion of the zone in the grain (mol %) | Diameter of sphere having the volume of the grain | Overall composition of the grain (mol-%) |
|---|---|---|---|---|---|
| A (Comparison) | I | $AgBr_{0.995}I_{0.005}$ | 100 | 0.80 μm | 99.5 $Br^-$ |
| | | | | | 0.5 $I^-$ |
| B (Comparison) | I | AgBr | 100 | 0.63 μm | 100 $Br^-$ |
| C (Invention) | I | AgBr | 10 | 1.4 μm | 95.05 $Br^-$ |
| | II | $AgBr_{0.92}I_{0.08}$ | 60 | | 4.95 I |
| | III | $AgBr_{0.95}I_{0.005}$ | 30 | | |
| D (Invention) | I | AgBr | 34 | 1.1 μm | 2.00 $Cl^-$ |
| | II | $AgBr_{0.8}I_{0.2}$ | 36 | | 90.67 $Br^-$ |
| | III | $AgCl_{0.5}Br_{0.5}$ | 4 | | 7.33 $I^-$ |
| | IV | $AgBr_{0.995}I_{0.005}$ | 26 | | |
| E (Invention) | I | AgBr | 10 | 0.56 μm | 2.00 $Cl^-$ |
| | II | $AgBr_{0.8}I_{0.2}$ | 20 | | 90.25 $Br^-$ |
| | III | AgBr | 9 | | 7.75 $I^-$ |
| | IV | $AgCl_{0.5}Br_{0.5}$ | 4 | | |
| | V | AgBr | 9 | | |
| | VI | $AgBr_{0.8}I_{0.2}$ | 18 | | |
| | VII | $AgBr_{0.0995}I_{0.005}$ | 30 | | |

PREPARATION OF THE LAYERS 500 ml of each of the emulsions (A to E) containing the quantity of silver halide equivalent to 200 g $AgNO_3$ per kg and 80 g of gelatine per kg were spectrally sensitized to red and then stabilized with 0.4 millimol of the given stabilizer. A comparison sample was prepared without stabilizer.

A colour coupler emulsion of 25 g of colour coupler C 10, 25 g of tricresylphosphate and 25 g of gelatine was added to the spectrally sensitized and stabilized emulsion thus obtained.

In addition, a DIR coupler emulsion containing 1.5 g of DIR coupler DIR 1 was added.

The casting solutions thus obtained were cast on a transparent layer support (application of silver halide expressed in terms of $AgNO_3$: 2.5 g $AgNO_3$ per $m^2$).

The layers were covered with a protective gelatine layer (0.5 μm thickness of dry layer) and hardened.

After imagewise exposure (1/100 sec.) behind a grey sensitometer wedge (in each case a fresh sample and the sample before and after storage under the storage conditions described below) the samples were processed by a colour negative process described in "The British Journal of Photography", 1974, pages 597 and 598.

To assess the response to storage, one sample was processed in the fresh condition (=without storage, i.e. within 6 hours after exposure); a second sample was stored for 14 days at 90% relative humidity and a temperature of 35° C. before exposure and then processed within 6 hours after exposure; a third sample was exposed and then stored for 14 days as above at 90% relative humidity and T=35° C. before being processed.

The results (change in photographic sensitivity and fogging due to storage) are summarized in the following Tables.

The following were used as comparison stabilizers:

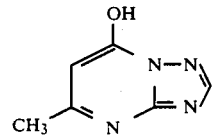

I

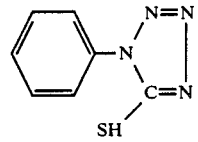

II

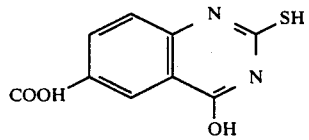

III

TABLE

| Emulsion | Stabilizer | Sensitivity (E)[DIN] Fresh = without storage $E_o$ | Stored without exposure $E_u$ | $\Delta E_u$ | Stored after exposure $E_b$ | $\Delta E_b$ | Fog (S) Fresh = without storage | After Storage | ΔS |
|---|---|---|---|---|---|---|---|---|---|
| A | none | 15,6 | 8,8 | −6,8 | 8,6 | −7,0 | 0,52 | 0,87 | 0,37 |
| | I | 18,9 | 15,7 | −3,2 | 1,54 | −3,5 | 0,24 | 0,42 | 0,18 |
| | II | 16,3 | 14,7 | −1,6 | 14,5 | −1,8 | 0,10 | 0,18 | 0,08 |

TABLE-continued

| Emulsion | Stabilizer | Sensitivity (E)[DIN] Fresh = without storage $E_o$ | Stored without exposure $E_u$ | $\Delta E_u$ | Stored after exposure $E_b$ | $\Delta E_b$ | Fog (S) Fresh = without storage | After Storage | ΔS |
|---|---|---|---|---|---|---|---|---|---|
| | III | 20,2 | 17,1 | −3,1 | 17,0 | −3,2 | 0,17 | 0,30 | 0,13 |
| | St-1 | 20,2 | 17,6 | −2,6 | 17,3 | −2,9 | 0,16 | 0,28 | 0,12 |
| | St-8 | 20,3 | 17,4 | −2,9 | 17,4 | −2,9 | 0,14 | 0,28 | 0,14 |
| | St-11 | 19,9 | 16,8 | −3,1 | 16,9 | −3,0 | 0,15 | 0,29 | 0,14 |
| | I + St-8 | 20,1 | 16,9 | −3,2 | 16,9 | −3,5 | 0,16 | 0,31 | 0,15 |
| B | none | 15,4 | 4,6 | −10,8 | 6,7 | −8,7 | 0,73 | 1,16 | 0,43 |
| | I | 17,8 | 11,6 | −6,2 | 12,0 | −5,8 | 0,29 | 0,62 | 0,33 |
| | II | 15,8 | 12,8 | −3,0 | 13,1 | −2,7 | 0,14 | 0,25 | 0,11 |
| | III | 18,9 | 13,1 | −5,8 | 13,5 | −5,4 | 0,19 | 0,44 | 0,25 |
| | St-1 | 18,6 | 13,0 | −5,6 | 13,4 | −5,2 | 0,20 | 0,47 | 0,27 |
| | St-8 | 19,0 | 14,1 | −4,9 | 14,0 | −5,0 | 0,18 | 0,41 | 0,23 |
| | St-11 | 18,4 | 13,3 | −5,1 | 13,5 | −4,9 | 0,17 | 0,40 | 0,23 |
| | I + St-8 | 18,1 | 12,6 | −5,5 | 13,1 | −5,0 | 0,20 | 0,48 | 0,28 |
| C | none | 19,2 | 14,0 | −5,2 | 12,4 | −6,8 | 0,36 | 0,65 | 0,29 |
| | I | 23,3 | 20,7 | −2,6 | 20,3 | −3,0 | 0,18 | 0,33 | 0,15 |
| | II | 20,6 | 19,2 | −1,4 | 19,0 | −1,6 | 0,08 | 0,15 | 0,07 |
| | III | 23,5 | 20,0 | −3,5 | 19,8 | −3,7 | 0,14 | 0,28 | 0,14 |
| | St-1 | 24,2 | 23,8 | −0,4 | 23,6 | −0,6 | 0,05 | 0,08 | 0,03 |
| | St-8 | 24,5 | 24,0 | −0,5 | 24,0 | −0,5 | 0,04 | 0,08 | 0,04 |
| | St-11 | 24,0 | 23,4 | −0,6 | 23,1 | −0,9 | 0,06 | 0,12 | 0,06 |
| | I + St-8 | 23,7 | 22,9 | −0,8 | 22,7 | −1,0 | 0,06 | 0,11 | 0,05 |
| D | none | 15,5 | 9,7 | −5,8 | 8,2 | −7,3 | 0,46 | 0,90 | 0,44 |
| | I | 20,6 | 17,9 | −2,7 | 17,0 | −3,6 | 0,21 | 0,40 | 0,19 |
| | II | 17,0 | 16,5 | −0,6 | 16,1 | −1,0 | 0,12 | 0,17 | 0,05 |
| | III | 21,2 | 18,0 | −3,2 | 16,8 | −4,4 | 0,16 | 0,31 | 0,15 |
| | St-1 | 22,4 | 22,0 | −0,4 | 21,6 | −0,8 | 0,06 | 0,11 | 0,05 |
| | St-8 | 22,5 | 22,1 | −0,4 | 21,8 | −0,7 | 0,06 | 0,11 | 0,05 |
| | St-11 | 22,0 | 21,8 | −0,2 | 21,5 | −0,5 | 0,07 | 0,13 | 0,06 |
| | I + St-8 | 21,9 | 21,4 | −0,5 | 21,0 | −0,9 | 0,09 | 0,15 | 0,16 |
| E | none | 11,4 | 6,0 | −5,4 | 4,8 | −6,6 | 0,39 | 0,76 | 0,37 |
| | I | 16,3 | 12,6 | −3,7 | 12,0 | −4,3 | 0,20 | 0,38 | 0,18 |
| | II | 11,5 | 10,3 | −1,2 | 9,60 | −1,9 | 0,11 | 0,18 | 0,07 |
| | III | 16,6 | 11,9 | −4,7 | 10,5 | −6,1 | 0,14 | 0,30 | 0,16 |
| | St-1 | 17,0 | 16,2 | −0,8 | 15,6 | −1,4 | 0,07 | 0,09 | 0,02 |
| | St-8 | 17,0 | 16,1 | −0,9 | 15,5 | −1,5 | 0,06 | 0,09 | 0,01 |
| | St-11 | 17,0 | 16,3 | −0,7 | 15,4 | −1,6 | 0,07 | 0,10 | 0,03 |
| | I + St-8 | 16,7 | 16,0 | −0,7 | 15,0 | −1,7 | 0,08 | 0,13 | 0,05 |

The results show that the present invention provides an improvement in the sensitivity/fogging ratio.

We claim:

1. Photographic recording material containing at least one light-sensitive silver halide emulsion layer and one stabilizer, characterized in that the silver halide emulsion layer contains silver halide grains having a core consisting mainly of silver bromide, an outermost zone consisting of silver iodobromide with a relatively low iodide content and at least one intermediate zone consisting of a silver iodobromide with a relatively high silver iodide content of at least 5 mol percent and, as stabilizer, a compound corresponding to the following formula I or a tautomer thereof:

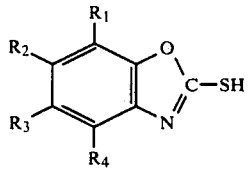

wherein $R_1$ to $R_4$ may be identical or different and denote hydrogen or $C_1$–$C_4$–alkyl with the proviso that at least one of the substituents $R_1$ to $R_4$ contains an acidic substituent or is itself an acidic substituent.

2. Color photographic recording material according to claim 1, characterized in that it contains, as acid substituent, a carboxylic group, a sulphone group or a sulphonamide group.

3. Photographic recording material according to claims 1 or 2, characterized in that the ratio of iodide to the other halides is greater in the grain interior than in the outermost zone of the silver halide grains.

4. Photographic recording material according to claims 1 or 2, characterized in that at least one silver halide emulsion layer has a color coupler associated therewith.

5. Photographic recording material according to claims 1 or 2, characterized in that it contains at least one blue-sensitive, one green-sensitive and one red-sensitive layer, at least one of which is split into at least two partial layers differing in their sensitivity.

6. Photographic recording material according to claim 1, characterized in that the at least one intermediate zone consists of 7 to 40 mol-% silver iodide, and the difference between the iodide content of this zone and the outermost zone with less iodide content is at least 6 mol-% silver iodide.

7. Process for the production of photographic images by imagewise exposure and development of a color photographic material, characterized in that a material according to claims 1 or 2 is used.

8. Photographic recording material containing at least one light-sensitive silver halide emulsion layer and one stabilizer, characterized in that the silver halide emulsion layer contains silver halide grains having a core consisting mainly of silver bromide, an outermost zone consisting of silver iodobromide with a relatively low iodide content and at least one intermediate zone consisting of a silver iodobromide with a relatively high silver iodide content of at least 5 mol percent and, as stabilizer, a compound corresponding to at least one of the following compounds:
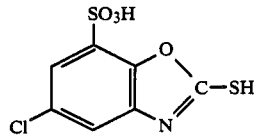
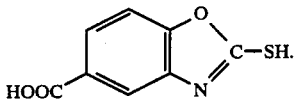
* * * * *